US010498068B2

(12) United States Patent
Takagi

(10) Patent No.: US 10,498,068 B2
(45) Date of Patent: Dec. 3, 2019

(54) CONNECTOR WITH STACKED SUB-HOUSINGS

(71) Applicant: Sumitomo Wiring Systems, Ltd., Yokkaichi, Mie (JP)

(72) Inventor: Kohei Takagi, Mie (JP)

(73) Assignee: Sumitomo Wiring Systems, Ltd. (JP)

( * ) Notice: Subject to any disclaimer, the term of this patent is extended or adjusted under 35 U.S.C. 154(b) by 0 days.

(21) Appl. No.: 16/133,752

(22) Filed: Sep. 18, 2018

(65) Prior Publication Data

US 2019/0103698 A1 Apr. 4, 2019

(30) Foreign Application Priority Data

Sep. 29, 2017 (JP) ..... 2017-189954

(51) Int. Cl.
*H01R 13/502* (2006.01)
*H01R 13/436* (2006.01)

(52) U.S. Cl.
CPC ..... *H01R 13/4367* (2013.01); *H01R 13/502* (2013.01)

(58) Field of Classification Search
CPC ..... H01R 2103/00; H01R 13/4223; H01R 13/514; H01R 9/24; H01R 9/2408; H01R 13/4362
USPC ..... 439/595, 695, 701, 709, 710, 712, 717, 439/752, 752.5
See application file for complete search history.

(56) References Cited

U.S. PATENT DOCUMENTS 4,753,614 A * 6/1988 Weiner ..... H01R 13/514 439/717
5,288,251 A * 2/1994 Sumida ..... H01R 13/514 439/701
5,895,296 A * 4/1999 Okabe ..... H01R 13/514 439/701
6,343,959 B2 * 2/2002 Sato ..... H01R 13/6273 439/701
6,354,887 B2 * 3/2002 Maeda ..... H01R 13/514 439/701
6,406,335 B2 * 6/2002 Sato ..... H01R 13/514 439/701
6,579,129 B2 * 6/2003 Sato ..... H01R 13/514 439/456

(Continued)

FOREIGN PATENT DOCUMENTS

JP 2017-4737 1/2017

*Primary Examiner* — Thanh Tam T Le
(74) *Attorney, Agent, or Firm* — Gerald E. Hespos; Michael J. Porco; Matthew T. Hespos

(57) ABSTRACT

A connector (10) includes a stacked housing (11) configured by vertically stacking sub-housings (S) capable of accommodating terminals (T) in three or more stages. The stacked housing (11) includes, as the sub-housings (S), an upper sub-housing (S1) disposed in an uppermost stage, a middle sub-housing (S2) disposed to face the upper sub-housing (S1) and a lower sub-housing (S3) disposed in a lowermost stage. The upper sub-housing (S1) includes a retainer (35) for retaining the terminals (T) accommodated inside the middle sub-housing (S2) and the middle sub-housing (S2) includes at least two retainers (35) for retaining the terminals (T) accommodated in the upper sub-housing (S1) and the terminals (T) accommodated in the lower sub-housing (S3).

6 Claims, 15 Drawing Sheets

(56) References Cited

U.S. PATENT DOCUMENTS

| | | | | |
|---|---|---|---|---|
| 7,297,032 | B2 * | 11/2007 | Kobayashi | H01R 13/4361 439/595 |
| 7,425,160 | B2 * | 9/2008 | Lee | H01R 13/514 439/701 |
| 7,572,154 | B2 * | 8/2009 | Ichio | H01R 13/4361 361/735 |
| 7,695,315 | B2 * | 4/2010 | Hitchcock | H01R 13/4223 439/541.5 |
| 8,187,041 | B2 * | 5/2012 | Ito | H01R 13/4361 439/701 |
| 8,747,168 | B2 * | 6/2014 | Kida | H01R 13/506 439/701 |
| 8,915,758 | B2 * | 12/2014 | Shishikura | H01R 13/506 439/701 |
| 9,614,314 | B2 * | 4/2017 | Chikusa | H01R 13/4223 |
| 9,673,560 | B2 * | 6/2017 | Iihoshi | H01R 13/514 |
| 9,722,341 | B2 * | 8/2017 | Chikusa | H01R 13/4223 |
| 9,722,347 | B2 * | 8/2017 | Chikusa | H01R 13/506 |
| 2016/0365665 | A1 | 12/2016 | Chikusa et al. | |

* cited by examiner

CONNECTOR WITH STACKED SUB-HOUSINGS

BACKGROUND

Field of the Invention

This specification relates to a connector.

Related Art

Japanese Unexamined Patent Publication No. 2017-4737 discloses a connector with first and second housing bodies that are assembled by being stacked on one another. Cavities are arranged laterally side by side in each of the housing bodies and terminal fittings are inserted respectively into the cavities. The cavities are partitioned by separation walls. First retaining portions are formed on the separation walls of the first housing body and project toward the second housing body. Additionally, first retention receiving recesses are formed on the separation walls of the first housing body and are provided laterally alternately side by side on a surface facing the second housing body. Similarly, the second housing body has second retaining portions projecting from the respective separation walls of the second housing body toward the first housing body and second retention receiving recesses are provided laterally alternately side by side on a surface of the separation walls of the second facing the first housing body.

When the first and second housing bodies are assembled, the first retaining portions fit into the second retention receiving portions and the second retaining portions fit into the first retention receiving portions. In this way, the first and second retaining portions are arranged respectively to face and lock to the second and first terminal fittings so that the first and second terminal fittings cannot exit rearward from the first and second cavities. More particularly, the exit of the respective terminal fittings is restricted by locking the first and second housing bodies to the terminal fittings of the mating housing bodies. However, the housings and, eventually, the terminal fittings can be stacked only up to two stages.

As a countermeasure against this, thought has been given to providing a locking hole on an upper surface side of a sub-housing and a downward projecting retaining portion on the lower surface and to stack these sub-housings in three or more of stages. In this case, terminals other than those in the uppermost stage can be retained by fitting the respective retaining portions into the locking holes of the sub-housings disposed to face the retaining portions and locking the terminals in the locking holes. However, in this configuration, the terminals in the sub-housing disposed in an uppermost stage cannot be retained by another sub-housing. Thus, a component including only a retaining portion for retaining the terminals accommodated in the sub-housing in the uppermost stage without accommodating any terminal inside is necessary, which leads to an increase in the number of components.

SUMMARY

The invention relates to a connector with sub-housings that can accommodate terminals and that can be stacked vertically in three or more stages. The sub-housings include an upper sub-housing disposed in an uppermost stage, a middle sub-housing disposed to face the sub-housing in the uppermost-stage and a lower sub-housing disposed in a lowermost stage. The upper sub-housing includes a retainer for retaining the terminals accommodated inside the middle sub-housing and the middle sub-housing includes at least two retainers for retaining the terminals in the upper sub-housing and the terminals in the lower sub-housing. According to this configuration, the upper sub-housing locks the terminals in the middle sub-housing, and the middle sub-housing locks the terminals in both the upper sub-housing and the lower sub-housing. Thus, the terminal fittings are locked in a stacked housing composed of only the three sub-housings.

The retainer on the upper sub-housing and the retainers on the middle sub-housing are at the same position in a front-rear direction when the upper sub-housing and the middle sub-housing are stacked. According to this configuration, the terminals can be arranged in the stacked housing with the positions thereof aligned in the front-rear direction in correspondence with the respective retainers disposed at the same position in the front-rear direction. Thus, the respective terminals can be retained without enlarging the connector in the front-rear direction.

The middle sub-housing includes a second sub-housing disposed to face the upper sub-housing and capable of accommodating the terminals and at least one additional sub-housing disposed between the second sub-housing and the lower sub-housing and capable of accommodating the terminals. The retainer for retaining the terminals in the facing sub-housing constitutes the same retaining structure on a lower surface of the additional sub-housing and a lower surface of the second sub-housing. Additionally, the retention receiving portion capable of receiving the retainer of the facing sub-housing constitutes the same retention receiving structure on an upper surface of the additional sub-housing and an upper surface of the lower sub-housing. According to this configuration, the terminals can be accommodated inside the respective sub-housings in the stacked housing composed only of the sub-housings in four or more stages by additionally stacking an arbitrary number of additional sub-housings.

The connector includes first and second connectors, each of which has side walls for laterally covering the terminals in the stacked housing. The side walls are laterally arrangeable side by side with each other. Error connection preventing portions are embedded at different positions in a front-rear direction on the side walls of the first connector and the side walls of the second connector. The error connection preventing portions are provided for each sub-housing and are shaped to fit together in a predetermined stacking order.

According to this configuration, since the first and second connectors are provided with the error connection preventing portions shaped differently for each sub-housing, the sub-housings cannot be stacked in a wrong stacking order. Further, the error connection preventing portions of the first connector and the error connection preventing portions of the second connector are at different positions in the front-rear direction. Thus, the sub-housings for the respective connectors cannot be mistaken. Furthermore, the error connection preventing portions do not project from the side walls covering the terminals in the respective connectors. Thus, the connectors are not enlarged even if the error connection preventing portions are provided.

Accordingly, this specification discloses a connector capable of stacking terminals in three or more stages.

DETAILED DESCRIPTION

Figure 1:
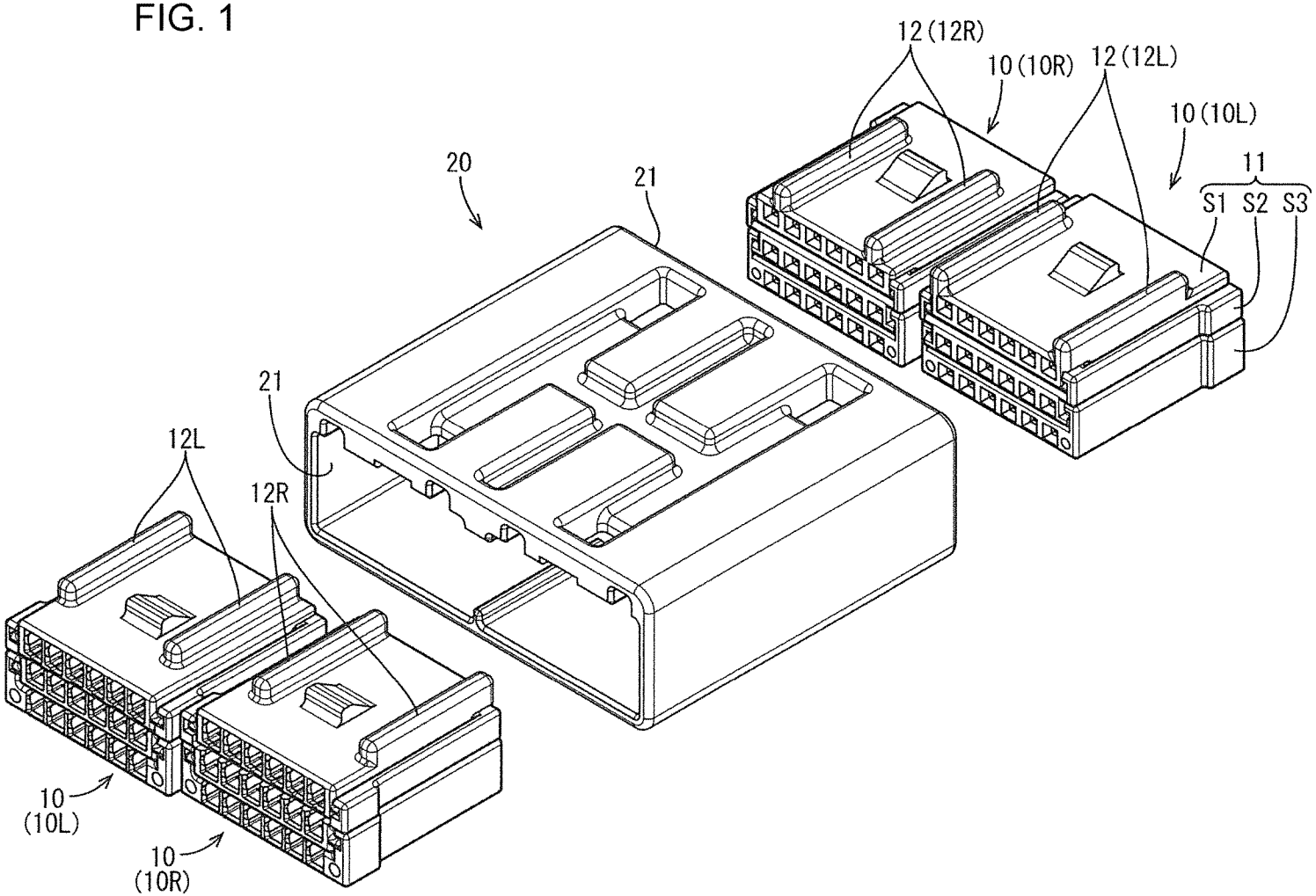
FIG. 1 is a perspective view showing connectors of a first embodiment and a relay connector.

A first embodiment is described with reference to FIGS. 1 to 10. Joint connectors 10L, 10R of this embodiment connect wires in a harness in a vehicle and are referred to collectively by the reference numeral 10. As shown in FIG. 1, each of the joint connectors 10 can fit into fitting recesses 21 provided on each of front and rear sides of one relay connector 20 while being laterally arranged side by side. Terminals T are accommodated inside each joint connector 10, as described later, and unillustrated relay terminals are accommodated inside the relay connector 20. The terminals T in the connectors 10 and the relay terminals in the relay connector 20 are connected conductively when the joint connectors 10 are connected to the relay connector 20. Thus, a signal input from one joint connector 10 can be branched and output to the other joint connectors 10.

Two guide ribs 12L project up from the ceiling surface of the joint connector 10L, and two guide ribs 12R project up on the ceiling surface of the joint connector 10R. The guide ribs 12L, 12R are referred to collective by the reference numeral 12 and extend in a front-rear direction. The guide ribs 12L of the first joint connector 10L are disposed on a left side facing the fitting recesses 21 of the relay connector 20, and the guide ribs 12R of the second joint connector 10R are disposed on a right side at positions slightly different from each other in a direction perpendicular to a connecting direction to the relay connector 20. In this way, the first and second joint connectors 10L, 10R cannot be inserted into the relay connector 20 in the wrong position. The first and second joint connectors 10L, 10R are identical in other respects, and therefore only the first joint connector 10L is described below.

As shown in FIG. 1, the first joint connector 10L includes a stacked housing 11 made of synthetic resin and this stacked housing 11 is configured by stacking three types of sub-housings S1, S2 and S3 (referred to collectively as the sub-housings S). These sub-housings S include an upper sub-housing S1, a middle sub-housing S2 and a lower sub-housing S3 in this order from the top in a properly stacked state. The upper sub-housing S1 on the basis of a stacking direction of the respective sub-housings S is referred to as an upper side concerning a vertical direction.

Figure 2:
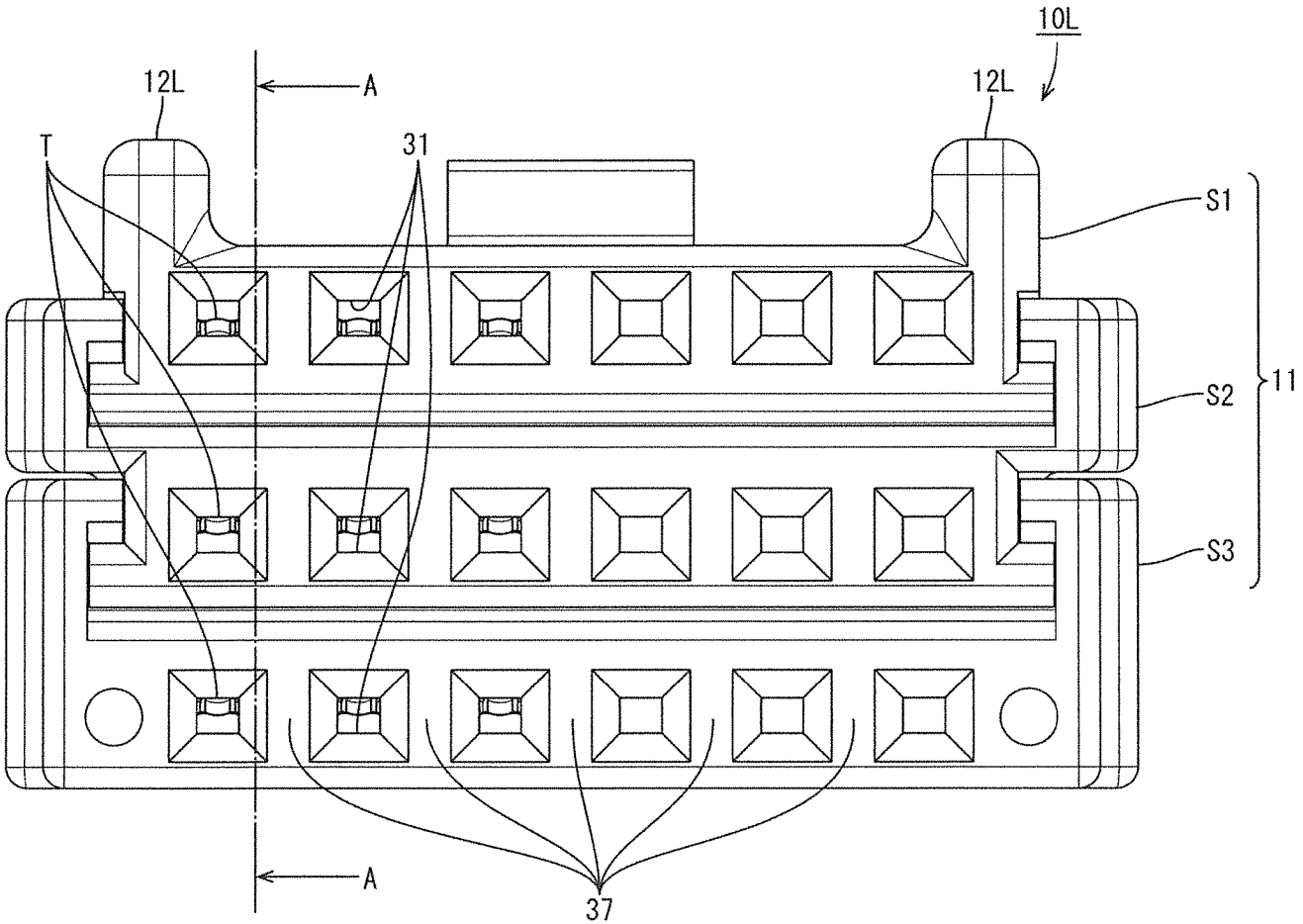
FIG. 2 is a front view of the connector.

As shown in FIGS. 2 to 6, each sub-housing S has a flat rectangular parallelepiped shape. Six cavities 31 penetrate each sub-housing S in the front-rear direction and are arranged side by side in a width direction with separation walls 37 disposed between adjacent cavities 31. As shown in FIG. 2, the cavities 31 are aligned vertically with the respective cavities 31 of the other sub-housings S when the respective sub-housings S1 to S3 are stacked properly. The terminals T can be inserted into each cavity 31 from behind.

Figure 3:
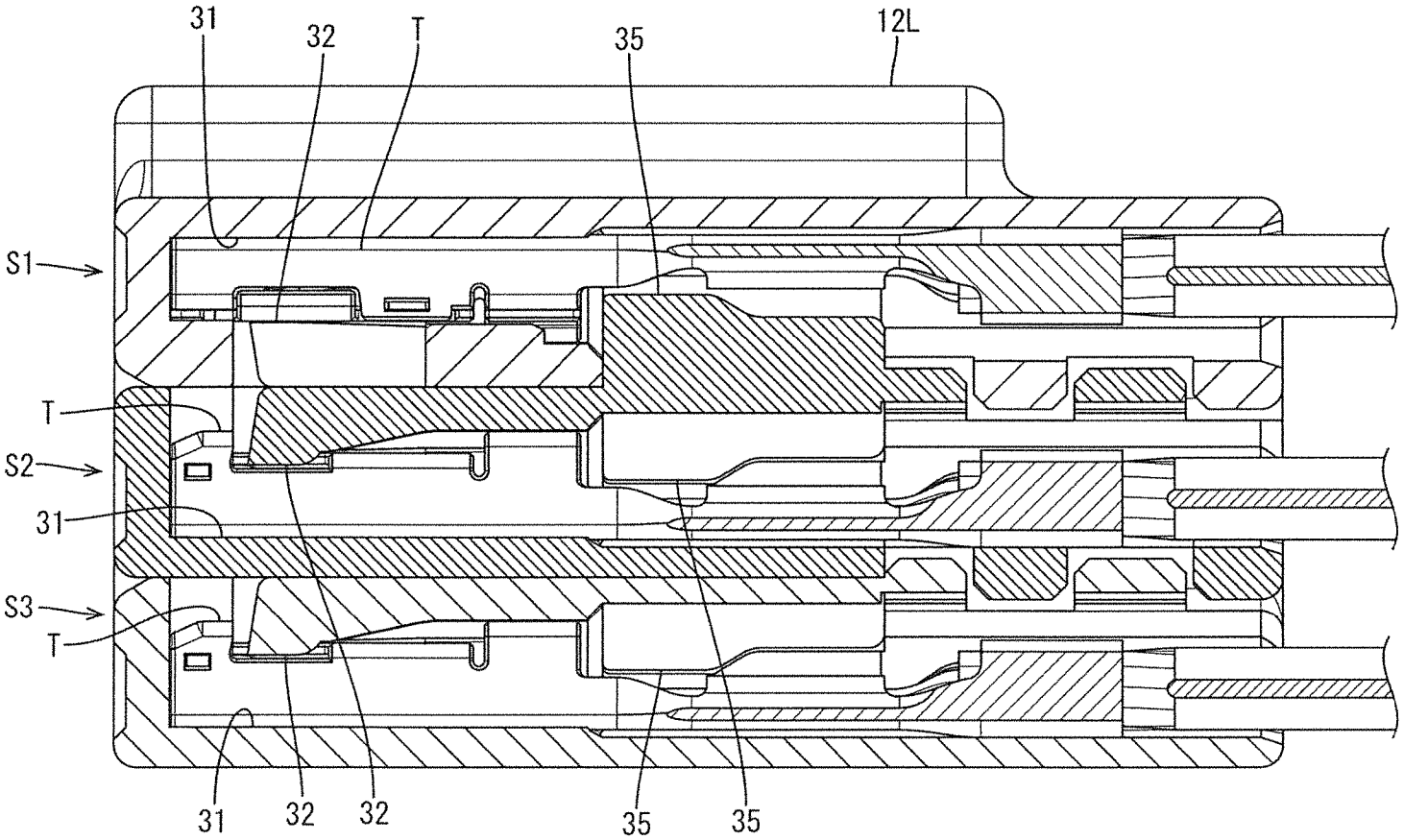
FIG. 3 is a section along A-A of FIG. 2.

As shown in FIG. 3, a vertically deflectable locking lance 32 is formed on an upper or lower surface of each cavity 31. The locking lance 32 can retain and hold the terminal T in the cavity 31 by locking the terminal T from behind.

Figure 4A:
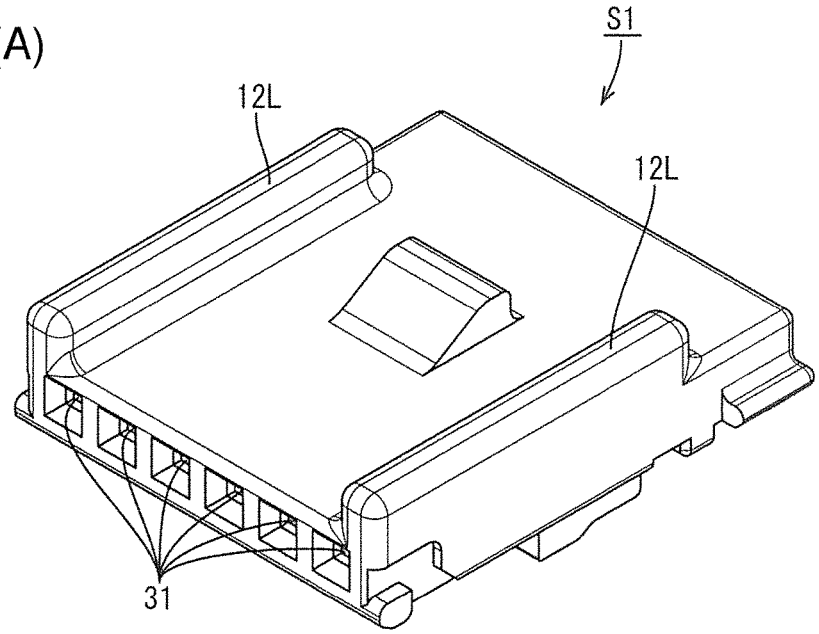
FIGS. 4(A) and 4(B) are perspective views showing an upper sub-housing.
Figure 5A:
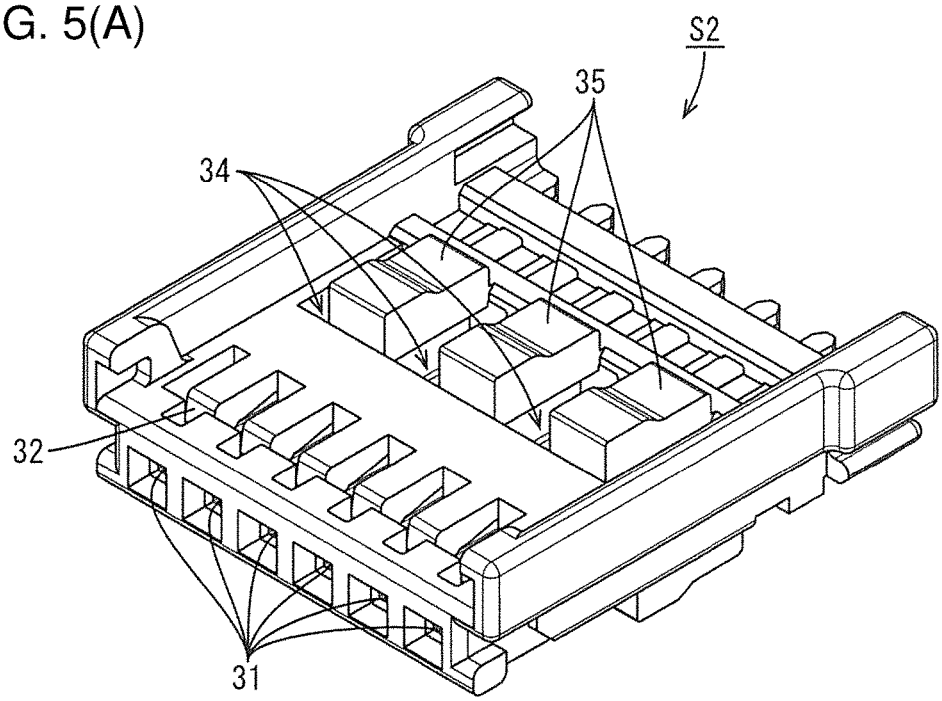
FIGS. 5(A) and 5(B) are perspective views showing a middle sub-housing.
Figure 5B:
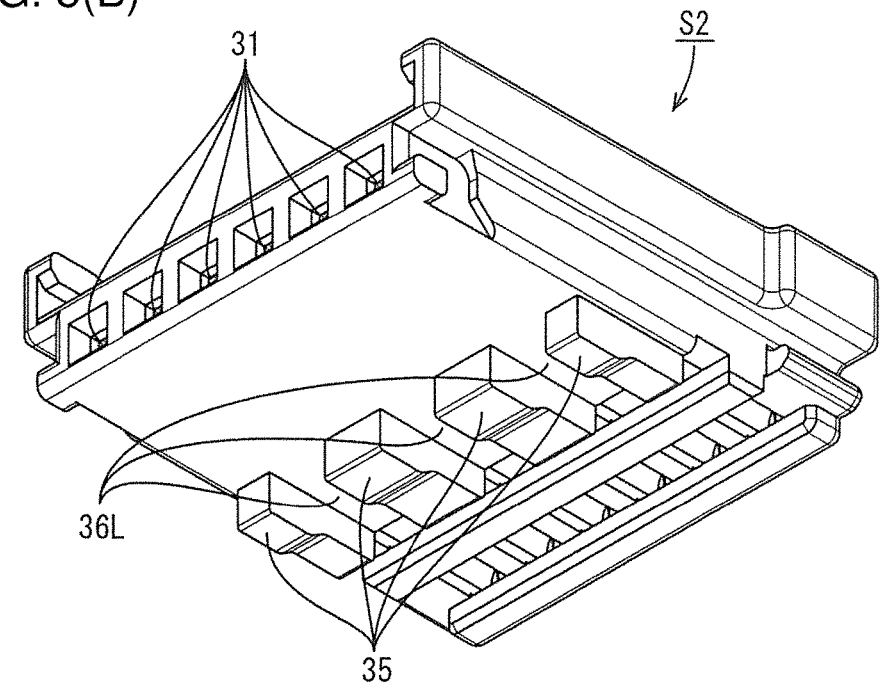
Figure 6A:
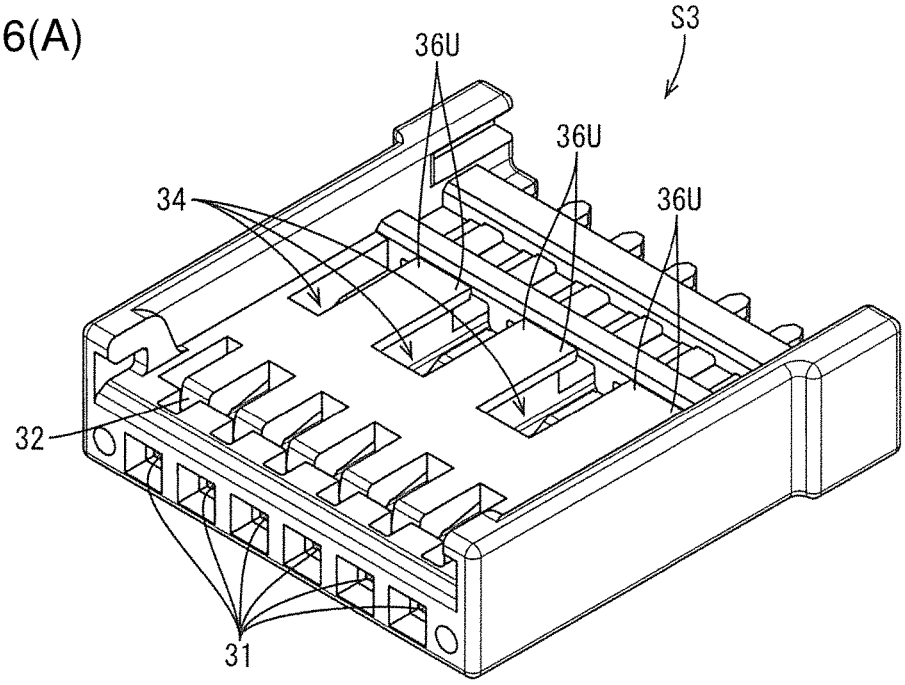
FIGS. 6(A) and 6(B) are perspective views showing a lower sub-housing.
Figure 6B:
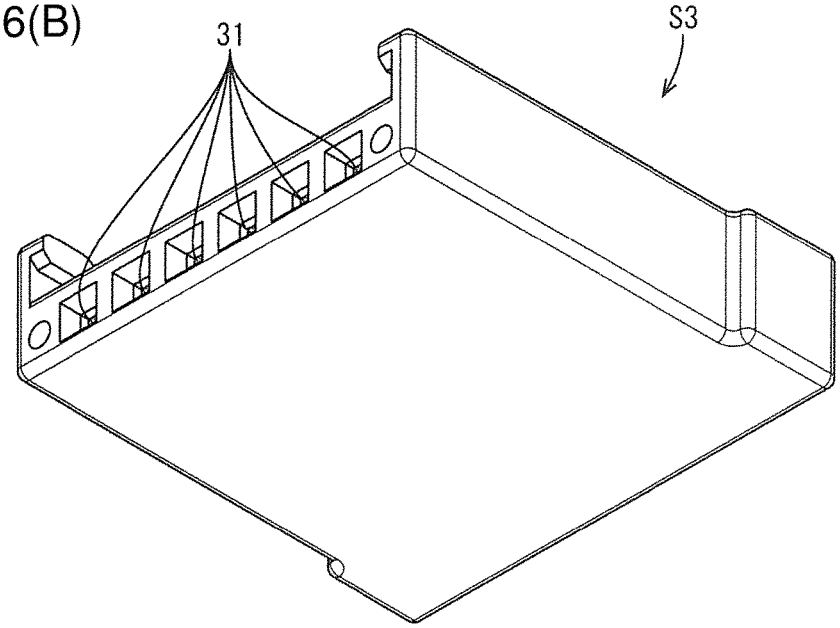

As shown in FIGS. 4 to 6, retention receiving portions 34 are formed on a lower surface of the upper sub-housing S1, an upper surface of the middle sub-housing S2 and an upper surface of the lowermost sub-housing S3. Each cavity 31 communicates with the outside of each sub-housing S through the retention receiving portion 34. Note that, in this embodiment, each retention receiving portion 34 allows a half of each cavity 31 in the width direction to communicate with outside.

Figure 10:
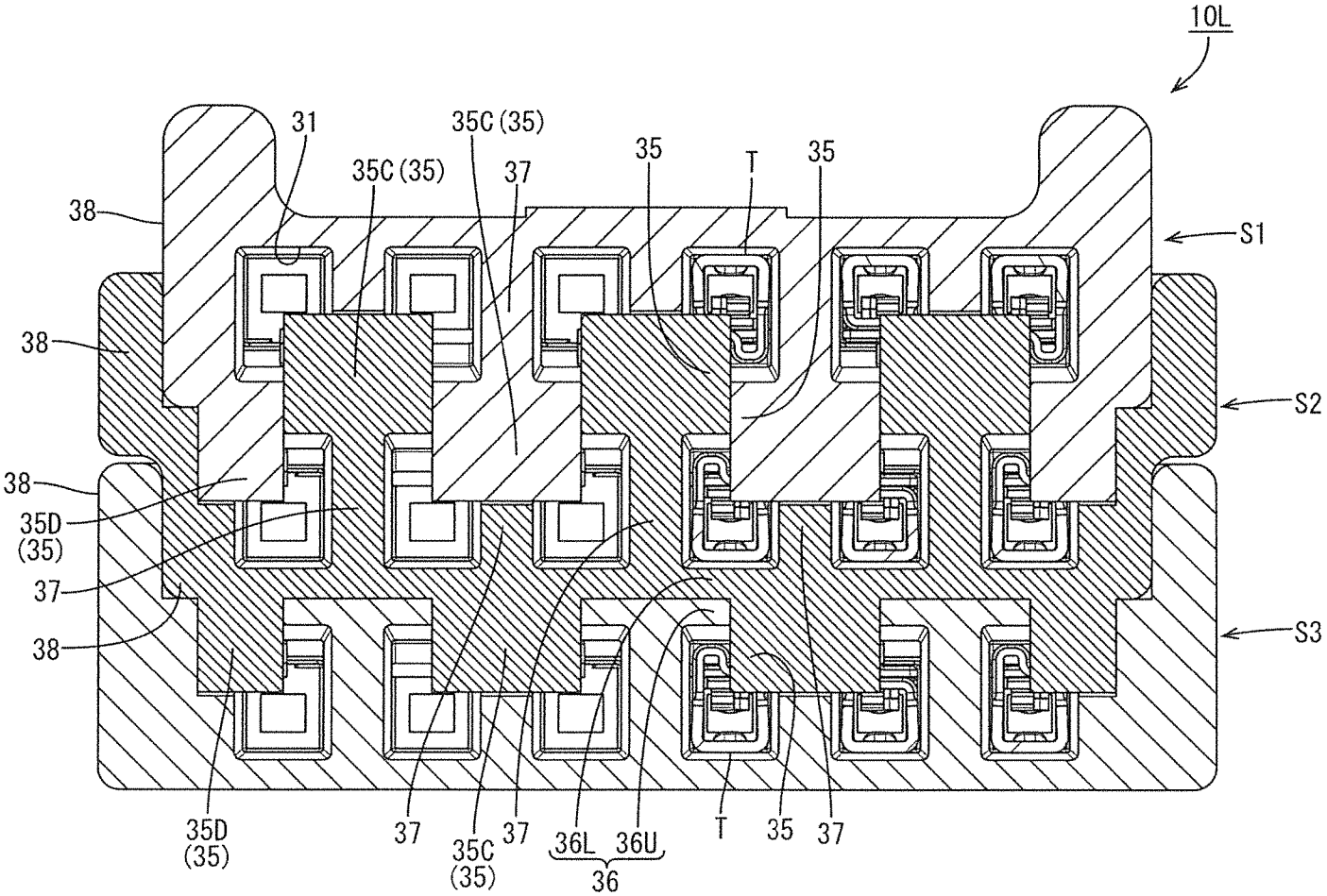
FIG. 10 is a view showing the respective sub-housings properly stacked.

Retainers 35 are provided on the lower surface of the upper sub-housing S1, the upper surface of the middle sub-housing S2 and the lower surface of the middle sub-housing S2. The retainers 35 are configured to enter the mating cavities 31 of the facing or mating sub-housing S through the retention receiving portions 34 of the mating sub-housing S when the respective sub-housings S are stacked properly. As shown in FIG. 10, the retainer 35 is coupled to the separation wall 37 or a side wall 38 of each sub-housing S. The retainers 35 project straight toward the mating cavities 31 while closing the halves of the respective cavities 31 in the width direction. As shown in FIG. 3, the retainer 35 can retain and hold the terminal T in the cavity 31 by locking a rectangular tube of the terminal T inserted into the cavity 31 from behind.

As shown in FIGS. 4 to 6, the locking lances 32 are provided on a side of each sub-housing S where the cavities 31 communicate with outside through the retention receiving portions 34 (i.e. on the lower surface in the upper sub-housing S1, the upper surface in the middle sub-housing S2 and the upper surface in the lower sub-housing S3). In this way, the terminals T are retained doubly and held by the locking of the locking lances 32 and the locking of the retainers 35.

Figure 4B:
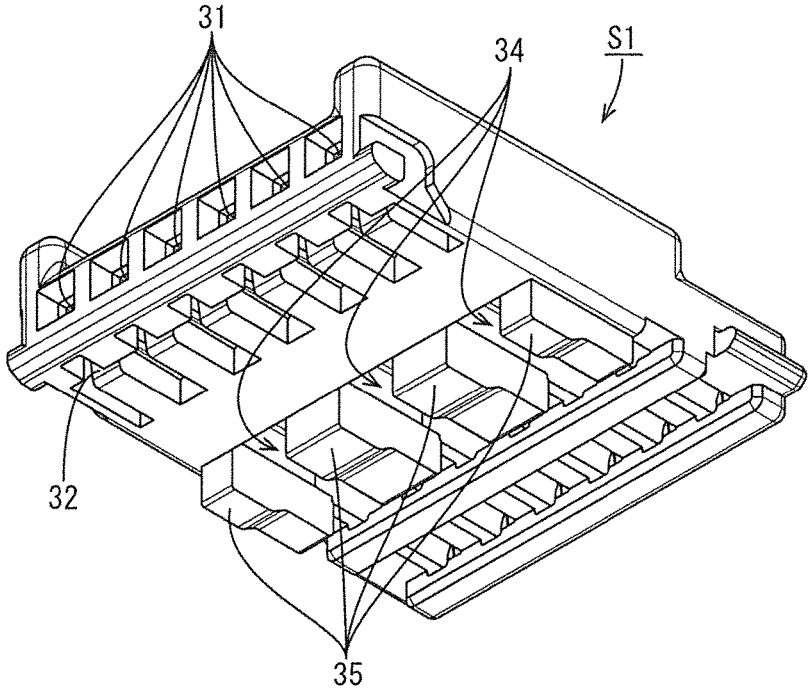
Figure 7A:
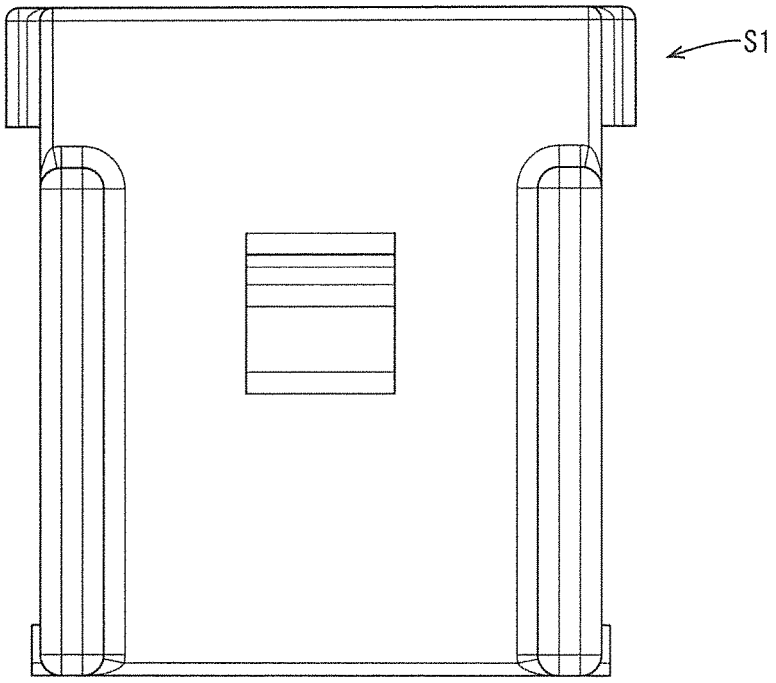
FIGS. 7(A) and 7(B) are views showing the upper and lower surfaces of the upper sub-housing.
Figure 7B:
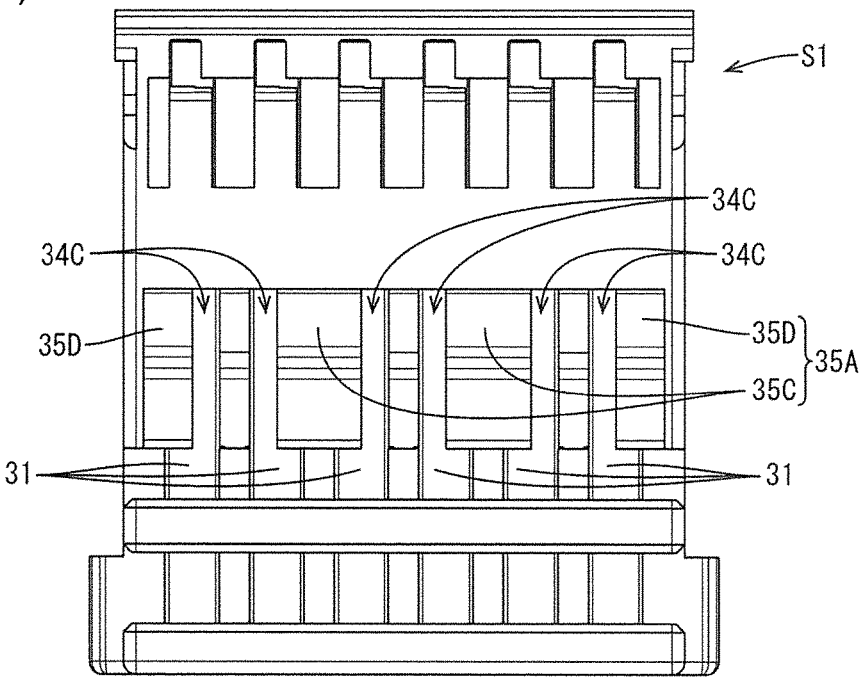

As shown in FIG. 4(B), the retention receiving portions 34 and the retainers 35 are disposed laterally alternately side by side on the lower surface of the upper sub-housing S1. In particular, as shown in FIG. 7(B), two spaced apart wide retainers 35C project out while closing a half of each of two adjacent cavities 31 in the width direction. Narrow retainers 35D project out while closing a half of only one cavity 31 in the width direction. The narrow retainers 35D are spaced laterally from the wide retainer 35C. Wide retention receiving portions 34C are disposed in clearances between the respective retainers 35C, 35D and allow two adjacent cavities 31 to communicate with the outside. Note that the configuration of the wide retainers 35C and the narrow retainers 35D and an arrangement relationship thereof are referred to below as a lower retaining structure 35A.

Figure 8A:
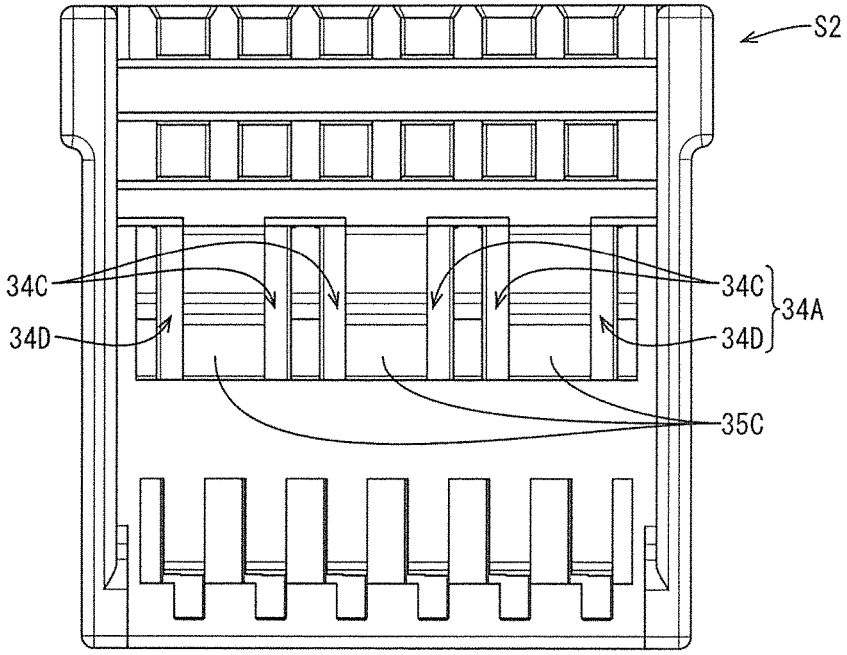
FIGS. 8(A) and 8(B) are views showing the upper and lower surfaces of the middle sub-housing.

The retainers 35 and the retention receiving portions 34 are disposed laterally alternately side by side on the upper surface of the middle sub-housing S2, as shown in FIG. 5(A). In particular, as shown in FIG. 8(A), two wide retention receiving portions 34C are disposed at a distance from each other. Additionally, narrow retention receiving portions 34D are spaced laterally from opposite sides of the wide retention receiving portions 34C at each of the sides of the wide retention receiving portions 34C and each allows only one cavity 31 to communicate with outside. The wide retainers 35C are disposed between adjacent retention receiving portions 34C, 34D. Note that the configuration of the wide retention receiving portions 34C and the narrow retention receiving portions 34D and an arrangement relationship thereof are referred to collectively below as an upper retention receiving structure 34A.

Figure 8B:
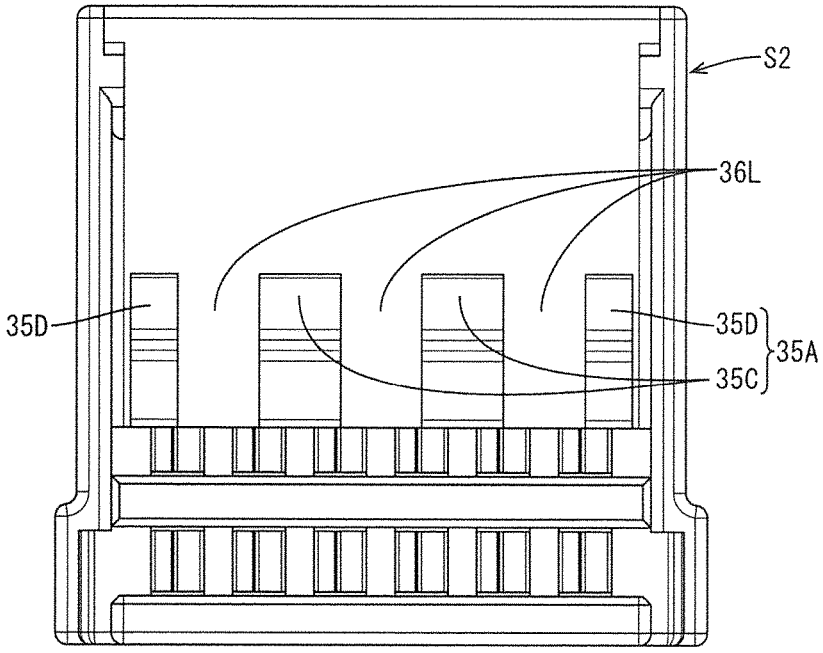

As shown in FIG. 5(B), the lower surface of the middle sub-housing S2 has retaining portions 35 laterally intermittently disposed side by side but has no retention receiving portion 34. In particular, as shown in FIG. 8(B), the retainers 35 form a lower retaining structure 35A similar to that on the lower surface (see FIG. 7(B)) of the uppermost sub-housing S1. Additionally, lower surface closing portions 36L are coupled to a bottom wall of the middle sub-housing S2 in the front-rear direction and are disposed in clearances between adjacent retainers 35C, 35D in the lower retaining structure 35A. As shown in FIG. 10, laterally central parts of the lower surface closing portions 36L are coupled to the separation walls 37 and both lateral end parts thereof are coupled to the respective retainers 35C, 35D, thereby closing the respective cavities 31 over the entire width.

Figure 9A:
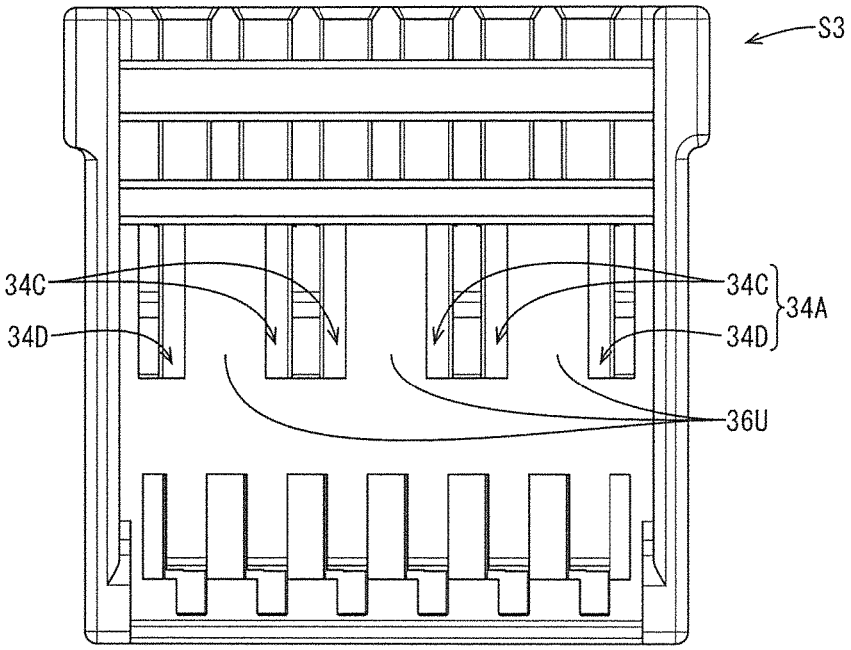
FIGS. 9(A) and 9(B) are views showing the upper and lower surfaces of the lower sub-housing.
Figure 9B:
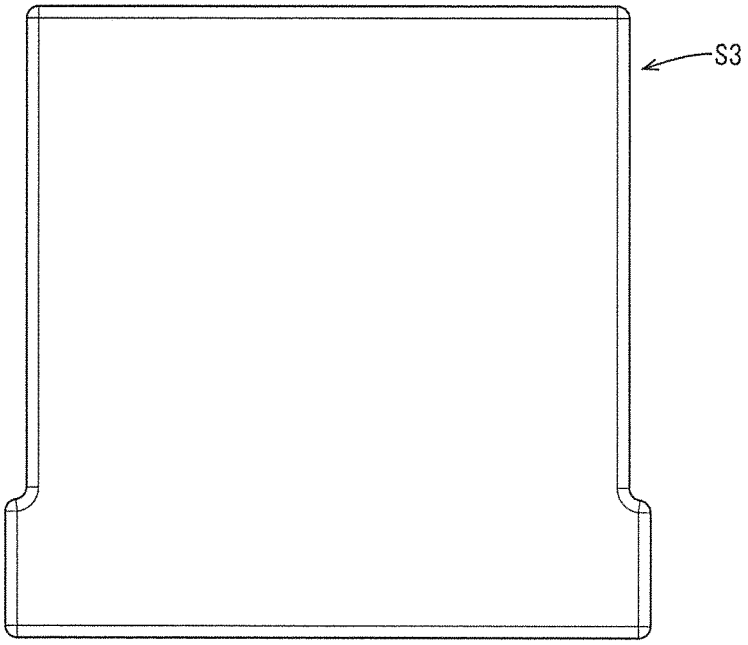

As shown in FIG. 6(A), no retainer 35 is disposed on the upper surface of the lower sub-housing S3, but the retention receiving portions 34 are disposed laterally intermittently side by side. In particular, as shown in FIG. 9(A), the retention receiving portions 34 form an upper retention receiving structure 34A similar to that on the upper surface (see FIG. 8(A) of the middle sub-housing S2, and upper surface closing portions 36U are coupled to a ceiling wall of the lower sub-housing S3 in clearances between adjacent retention receiving portions 34C, 34D of the upper retention receiving structure 34A. As shown in FIG. 10, laterally central parts of the upper surface closing portions 36U are coupled to the separation walls 37, thereby closing the halves of the respective cavities 31 in the width direction.

As shown in FIG. 10, when the terminals T are accommodated in the respective sub-housings S and the respective sub-housings S1 to S3 are stacked properly, the retainers 35 of the upper sub-housing S1 and the retainers 35 of the middle sub-housing S2 are arranged laterally alternately side by side between the respective cavities 31 of the upper sub-housing S1 and the respective cavities 31 of the middle sub-housing S2. The retainers 35 of the upper sub-housing S1 lock substantially widthwise halves of the terminals T in the cavities 31 of the middle sub-housing S2 and the retainers 35 of the middle sub-housing S2 lock substantially widthwise halves of the terminals T from below in the cavities 31 of the upper sub-housing S1.

Further, the upper surface closing portions 36U of the lower sub-housing S3 are in contact with the lower surface closing portions 36L of the middle sub-housing S2 to transmit a load from the middle sub-housing S2 to the separation walls 37 between the respective cavities 31 of the middle sub-housing S2 and the respective cavities 31 of the lowermost sub-housing S3. The retainers 35 of the middle sub-housing S2 lock substantially widthwise halves of the terminals Tin the cavities 31 of the lower sub-housing S3.

With the sub-housings S1 to S3 properly stacked, the retainers 35 of the uppermost sub-housing S1, the retainers 35 on the upper surface of the middle sub-housing S2 and the retainers 35 on the lower surface of the middle sub-housing S2 have their front ends aligned in the front-rear direction, as shown in FIG. 3.

As just described, the connector 10 of this embodiment has a stacked housing 11 configured by vertically stacking the sub-housings S capable of accommodating the terminals T in three or more stages. The sub-housings S include the upper sub-housing S1 disposed in the uppermost stage, the middle sub-housing S2 disposed to face the upper sub-housing S1 and the lower sub-housing S3 disposed in the lowermost stage. The upper sub-housing S1 includes the retainer 35 for retaining the terminals T accommodated in the middle sub-housing S2, and the middle sub-housing S2 includes at least two the retainers 35 for retaining the terminals T in the upper sub-housing S1 and the terminals T in the lower sub-housing S3. According to this configuration, the upper sub-housing S1 locks the terminals T in the middle sub-housing S2 disposed in the middle stage, and the middle sub-housing S2 locks the terminals T in the upper sub-housing S1 and the terminals T in the lower sub-housing S3 stacked to face the lower surface of the middle sub-housing S2. Thus, the terminals T can be accommodated inside the respective sub-housings S in the stacked housing 11 composed only of the sub-housings S in three stages.

Further, with the upper sub-housing S1 and the middle sub-housing S2 stacked, the retainer 35 on the upper sub-housing S1 and the retainers 35 on the middle sub-housing S2 are at the same position in the front-rear direction. According to this configuration, the terminals T can be arranged in the stacked housing with the positions thereof aligned in the front-rear direction in correspondence with the respective retainers 35 disposed at the same position in the front-rear direction. Therefore, the respective terminals T can be retained without enlarging the connector 10 in the front-rear direction.

Figure 11:
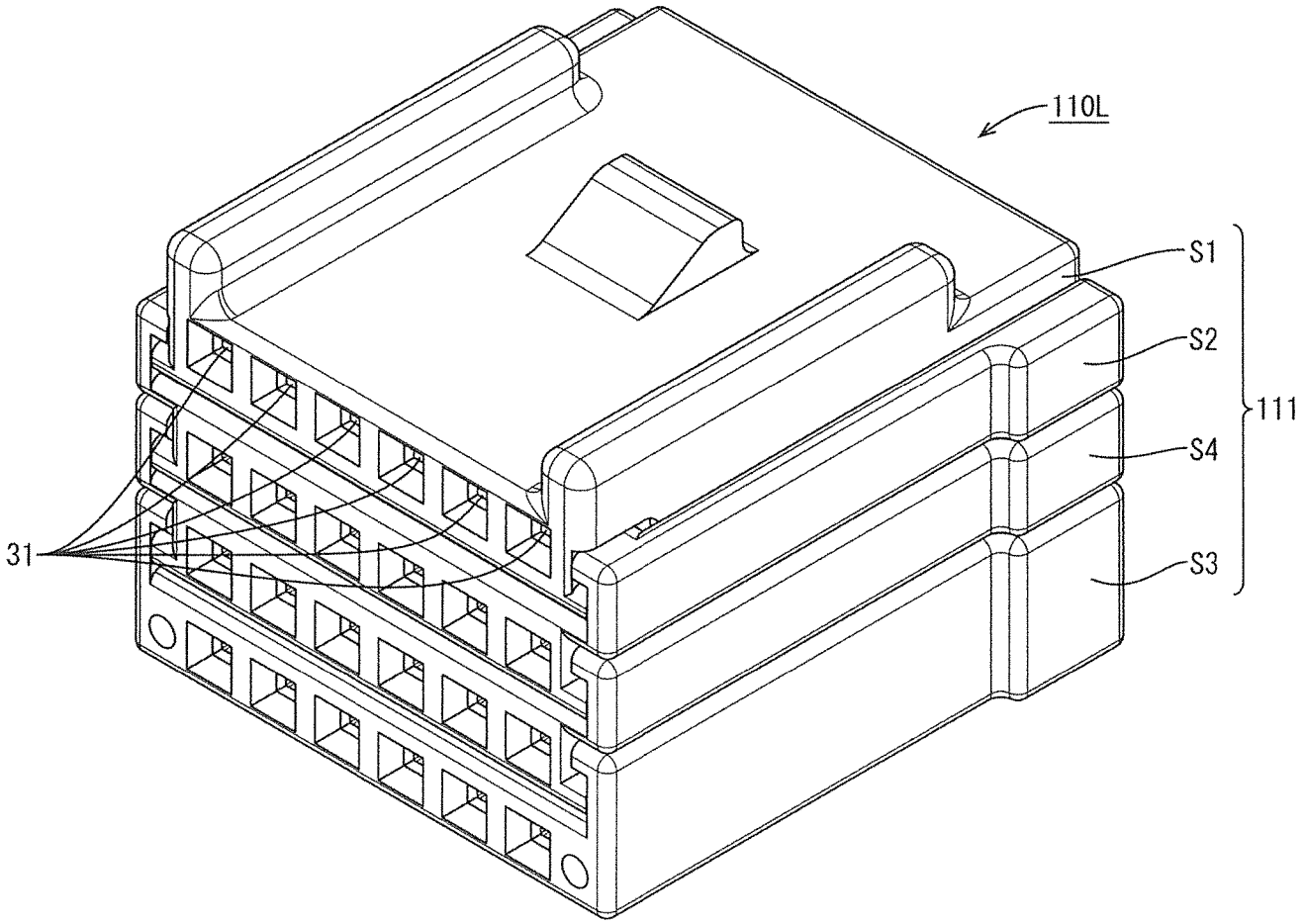
FIG. 11 is a perspective view showing a connector of a second embodiment.

A second embodiment is described with reference to FIG. 11. A connector 110 of this embodiment is configured by adding an additional sub-housing S4 to the stacked housing 11 of the first embodiment and stacking four sub-housings S as shown in FIG. 11. The same components, functions and effects as in the first embodiment are not described and the same components as in the first embodiment are denoted by the same terms and reference numerals.

A stacked housing 111 of this embodiment includes an upper sub-housing S1, a middle sub-housing S2 (an example of a second-stage sub-housing), the additional sub-housing S4 and a lower sub-housing S3. The additional sub-housing S4 has a flat rectangular parallelepiped shape, as shown in FIG. 11. Six cavities 31 penetrate the additional sub-housing S4 in a front-rear direction and are arranged side by side in a width direction with separation walls 37 disposed between the cavities 31 that are adjacent. The cavities 31 of the additional sub-housing S4 can accommodate terminals T.

Figure 12A:
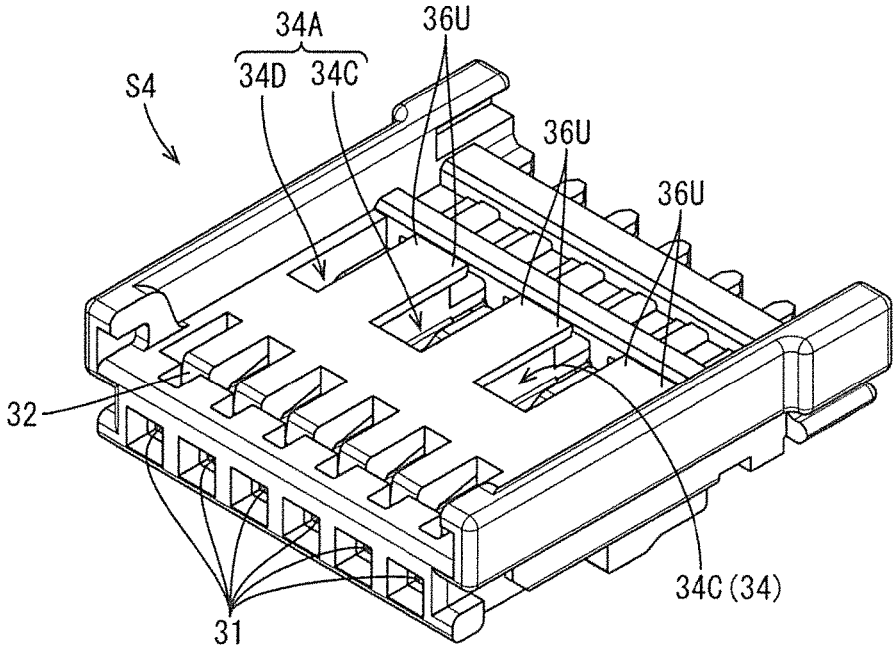
FIGS. 12(A) and 12(B) are perspective views showing an additional sub-housing.

As shown in FIG. 12(A), the upper surface of the additional sub-housing S4 is configured similar to the upper surface (see FIG. 6(A)) of the lower sub-housing S3. Specifically, as shown in FIG. 9(A), an upper retention receiving structure 34A is provided in the form of retention receiving portions 34. Additionally, upper surface closing portions 36U are coupled to a ceiling wall of the additional sub-housing S4 in clearances between adjacent retention receiving portions 34C, 34D in the upper retention receiving structure 34A.

Figure 12B:
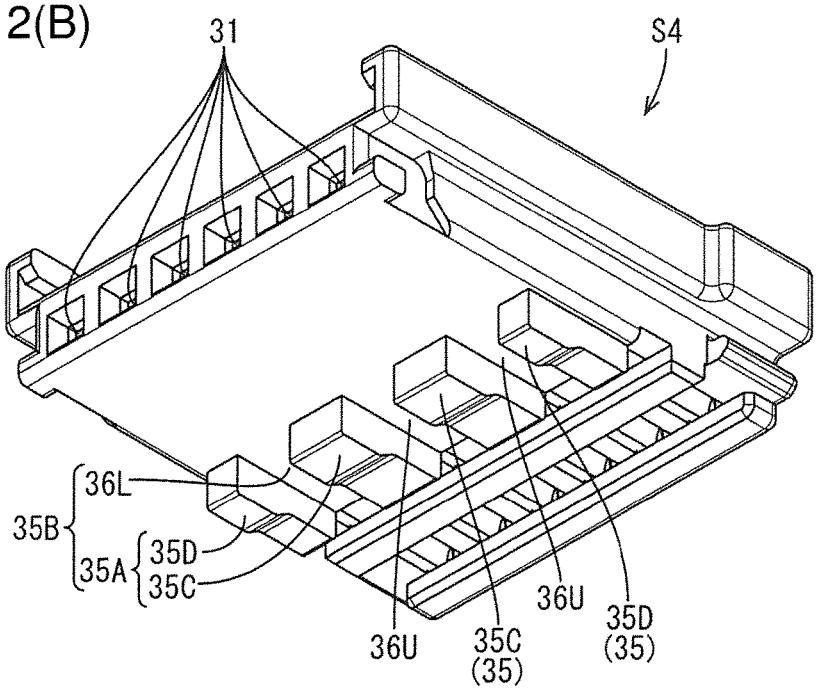

As shown in FIG. 12(B), the lower surface of the additional sub-housing S4 is configured similar to the lower surface (see FIG. 5(B)) of the middle sub-housing S2. Specifically, as shown in FIG. 8(B), a lower retaining structure 35A is provided in the form of retainers 35. Additionally, lower surface closing portions 36L are coupled to a bottom wall of the additional sub-housing S4 in clearances between adjacent retainers 35C, 35D in the lower retaining structure 35A.

In this way, the additional sub-housing S4 can be added between the middle sub-housing S2 and the lower sub-housing S3. In other words, the middle sub-housing S2 described in the first embodiment is composed of the middle sub-housing S2 and one additional sub-housing S4 in this embodiment and terminals are accommodated in two stages.

If the sub-housings S1, S2, S4 and S3 are stacked properly in this order from top to bottom, the lower retaining structure 35A on the lower surface of the middle sub-housing S2 is fit to the upper retention receiving structure 34A on the upper surface of the additional sub-housing S4. In this way, the terminals T accommodated in the additional sub-housing S4 are locked and retained by the retainers 35 of the middle sub-housing S2. Similarly, the lower retaining structure 35A on the lower surface of the additional sub-housing S4 is fit to the upper retention receiving structure 34A on the upper surface of the lower sub-housing S3. In this way, the terminals T accommodated in the lower sub-housing S3 are locked and retained by the retainers 35 of the additional sub-housing S3.

Note that the number of usable additional housings in the stacked housing 111 is not limited to one and an arbitrary number of additional sub-housings S4 can be added and used between the middle sub-housing S2 and the lower sub-housing S3. Thus, if another additional sub-housing S4 is, for example, added between the additional sub-housing S4 and the lowermost-stage sub-housing S3 stacked as described above, a stacked housing in which five sub-housings S are stacked is obtained.

As just described, according to this embodiment, the middle sub-housing S2 includes the second sub-housing S2 disposed to face the upper sub-housing S1 and capable of accommodating the terminals T and at least one additional sub-housing S4 disposed between the second sub-housing S2 and the lower sub-housing S3, the retainers 35 for retaining the terminals T accommodated in the facing sub-housing S are provided to form the same retaining structure 35A on the lower surface of the additional sub-housing S4 and the lower surface of the second sub-housing S2, and the retention receiving portions 34 capable of receiving the retainers 35 of the facing sub-housing S are provided to form the same retention receiving structure 34A on the upper surface of the additional sub-housing S4 and the upper surface of the lower sub-housing S3.

According to this configuration, by additionally stacking an arbitrary number of additional sub-housings S4, the terminals T can be accommodated inside each sub-housing S in the stacked housing 111 composed only of the sub-housings S in four or more stages.

A third embodiment of the invention is described with reference to FIGS. 13 to 15. In a connector 210 of this embodiment, error connection preventing portions 240L, 240R are provided on the first and second joint connectors 10L, 10R of the first embodiment to prevent the laterally adjacent sub-housings S1 to S3 from being mistaken when stacking the respective sub-housings S. Components corresponding to those of the first embodiment are denoted by the reference signs of the first embodiment plus 200. The same components, functions and effects as in the first embodiment are not described and the same components as in the first embodiment are denoted by the same terms and reference numerals.

Figure 13B:
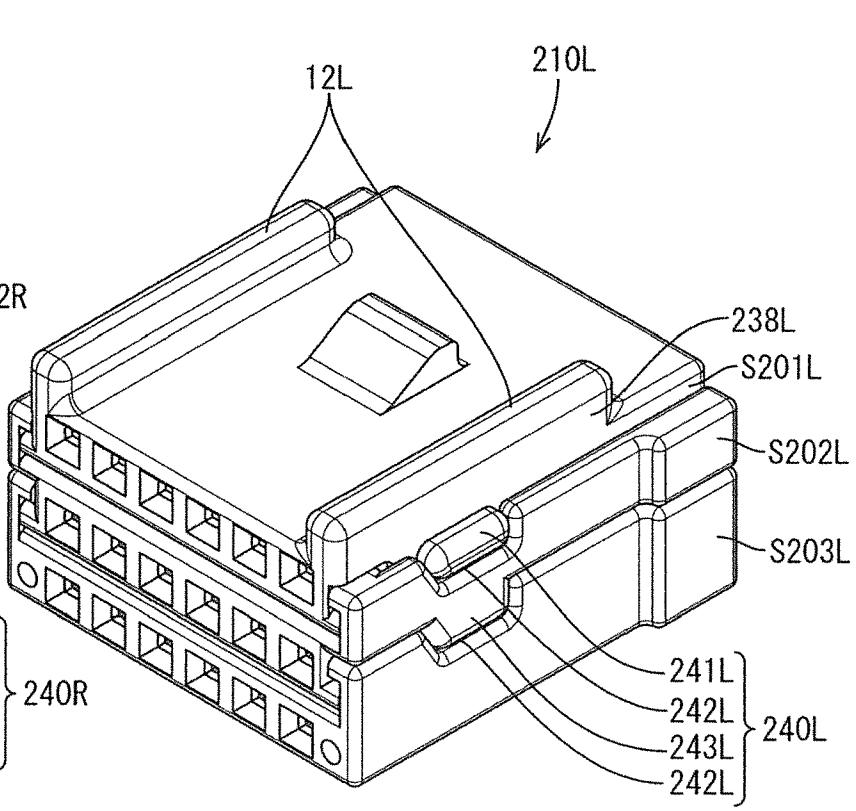
FIGS. 13(A) and 13(B) are perspective views of connectors of a third embodiment.
Figure 13A:
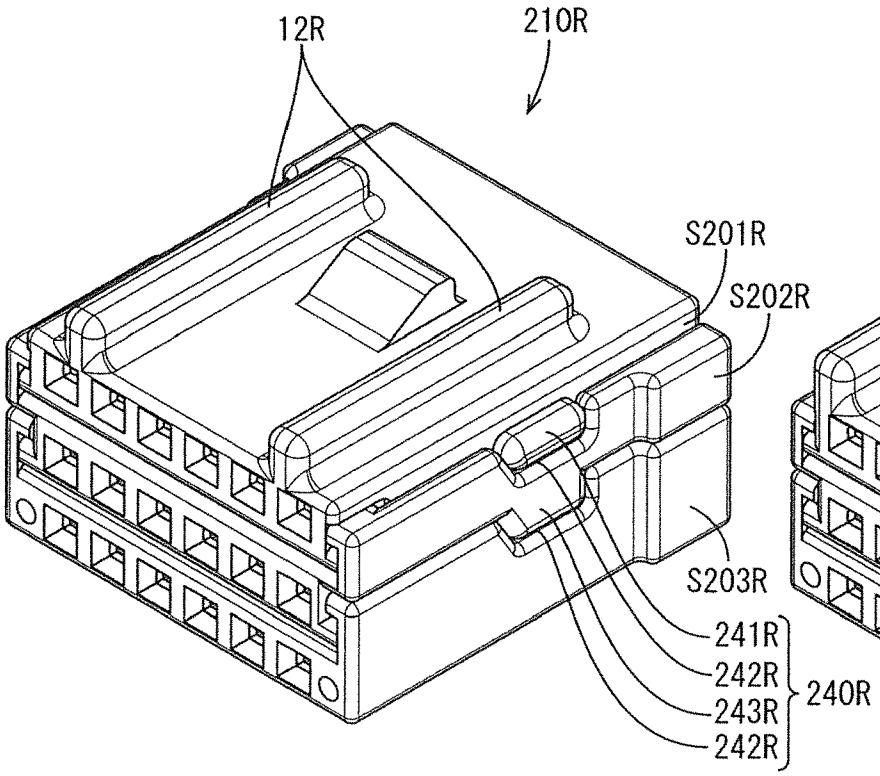
Figure 14A:
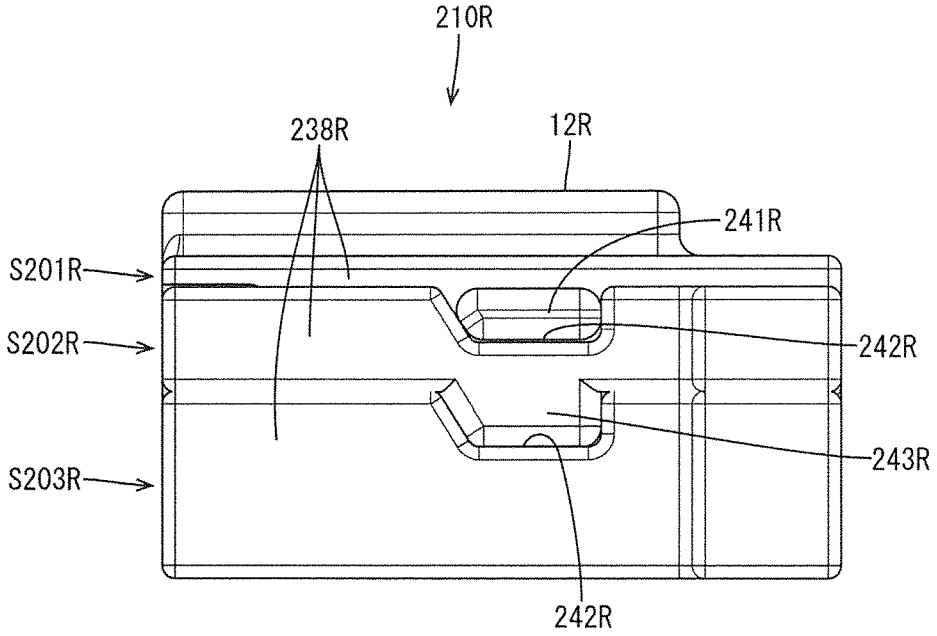
FIGS. 14(A) and 14(B) are side views of the connectors.

First error connection preventing portions 240L are provided on a first joint connector 210L, as shown in FIG. 13(B), and second error connection preventing portions 240R are provided on the second joint connector 210R, as shown in FIG. 13(A). The first and second error connection preventing portions 240L, 240R are provided at different positions in a front-rear direction in a state where the first and second joint connectors 210L, 210R are arranged with the front surfaces thereof aligned. Note that since the second error connection preventing portions 240R are similar to the first error connection preventing portions 240L in other configuration, only the first error connection preventing portions 240L are described below and the configuration of the second error connection preventing portions 240R is only shown with L replaced by R and not described.

The first error connection preventing portions 240L are composed of lateral protrusions 241L, fitting recesses 242L and downward protrusions 243L. One or more of these are disposed on each of first sub-housings S201L, S202L and S203L constituting a first stacked housing 211.

Figure 14B:
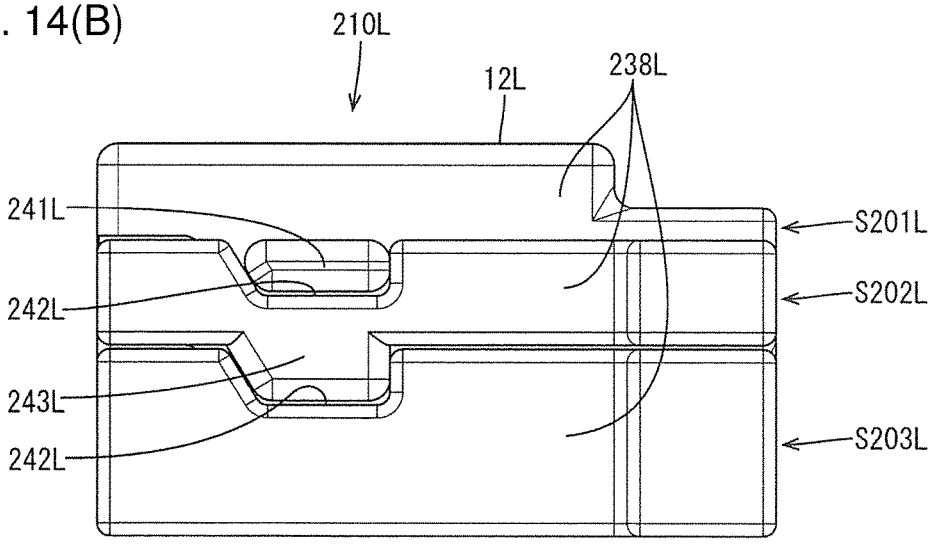
Figure 15A:
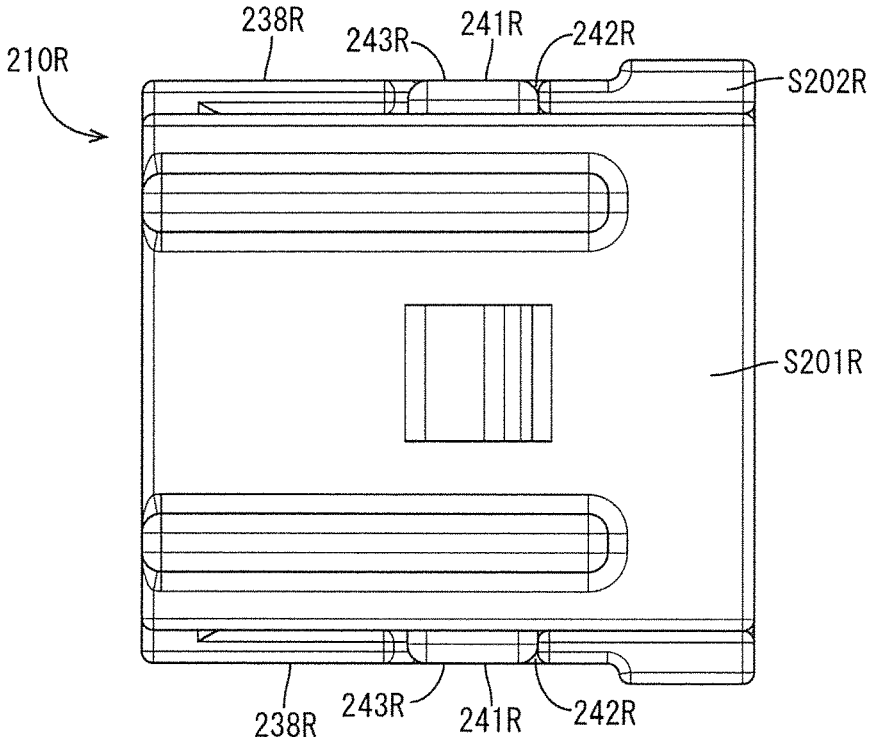
FIGS. 15(A) 15(B) are plan views of the connectors.
Figure 15B:
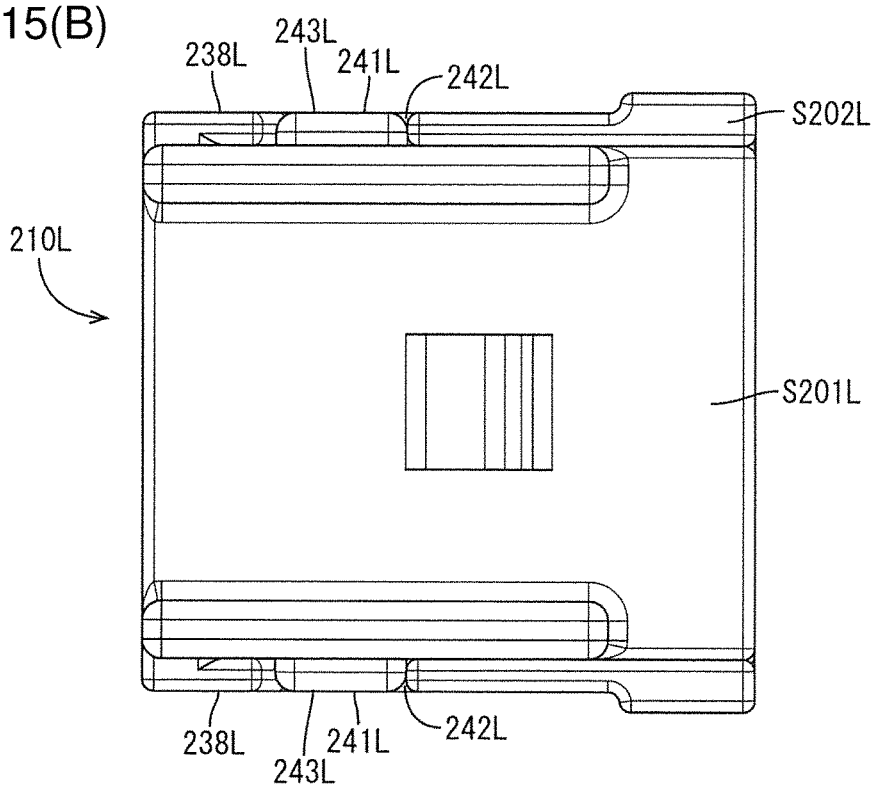

In particular, the lateral protrusions 241L project laterally out without projecting down, as shown in FIG. 14(B), on both left and right side walls 238L of the first upper sub-housing S201L, as shown in FIG. 15(B).

The fitting recesses 242L and the downward protrusions 243L are provided on both left and right side walls 238L of the first middle sub-housing S202L. The fitting recesses 242L are formed by recessing both side walls 238L of the first middle sub-housing S202L inwardly, and open up so as to be able to receive the lateral protrusions 241L fit from above. The downward protrusions 243L project down without causing parts of the side walls 238L of the first middle sub-housing S202L to project laterally out, and the projecting shape thereof can fit into the fitting recesses 242L.

Only the fitting recesses 242L are provided on both left and right side walls 238L of the first lowermost-stage sub-housing S203L. These fitting recesses 242L have the same shape as the fitting recesses 242L on the first middle sub-housing S202L.

With the respective first sub-housings S201L to S203L properly stacked, the lateral protrusions 241L of the first upper sub-housing S201L are fit into the fitting recesses 242L of the first middle sub-housing S202L from above. The downward protrusions 243L of the first middle sub-housing S202L are fit into the fitting recesses 242L of the first lower sub-housing S203L from above. A projecting end of each lateral protrusion 241L is flush with each side wall 238L of the first middle sub-housing S202L. In this way, the first error connection preventing portions 240L do not project from side walls 238 of the first stacked housing 211.

Specifically, according to this embodiment, the first and second connectors 210L, 210R are provided in each the stacked housing 211 includes the side walls 238 for laterally covering the terminals T and are laterally arrangeable side by side. The error connection preventing portions 240 are embedded at different positions mutually in the front-rear direction on the side walls 238L of the first connector 210L and the side walls 238 of the second connector 210R, and the error connection preventing portions 240 are provided for each sub-housing S and are shaped to fit to each other in a predetermined stacking order.

According to this configuration, the first and second joint connectors 210L, 210R are provided with the error connection preventing portions 241 to 243 shaped differently for each sub-housing S. Thus, the respective sub-housings S cannot be stacked in a wrong stacking order. Further, since the error connection preventing portions 240L of the first joint connector 210L and the error connection preventing portions 240R of the second joint connector 210R are at mutually different positions in the front-rear direction, the respective sub-housings S can be prevented from being mistaken between the joint connectors 210R, 210L. Furthermore, since the respective error connection preventing portions 240 do not project from the side walls 238L, 238R covering the terminals T in the respective joint connectors 210L, 210R and therefore do not enlarge the joint connectors 210R, 210L.

The invention is not limited to the above described and illustrated embodiments and can be, for example, embodied in the following forms.

In the above first to third embodiments, the respective retainers 35 of the respective sub-housings S are disposed at the same position in the front-rear direction when the respective sub-housings S are stacked properly. However, the respective retainers may not be at the same position in the front-rear direction. Further the respective retainers may not be configured to lock only the halves of the respective terminals T in the width direction. Thus, for example, the respective retainers provided on the lower surface of the uppermost-stage sub-housing and the respective retainers provided on the upper surface of the middle-stage sub-housing may be arranged alternately at different positions in the front-rear direction. In this case, since the respective retainers can lock the respective terminals over the entire width, the terminals can be more reliably retained.

Although the lower retaining structure 35A is structured such that the narrow retainers 35D are arranged at both sides of the wide retainers 35C in the first to third embodiments, the lower retaining structure 35A is not limited to this structure. For example, a lower retaining structure may be composed only of wide retainers or composed only of narrow retainers. Alternatively, full-width retainers for individually locking the respective terminals in the facing sub-housing over the entire width may be provided or one collective retainer for collectively locking all terminals in the facing sub-housing may be provided.

In the first to third embodiments, the retainers 35 on the lower surface of the upper sub-housing S1 constitute the lower retaining structure 35A similar to that on the lower surface of the middle sub-housing (second sub-housing) S2 and the retention receiving portions 34 on the upper surface of the middle sub-housing (second sub-housing) S2 constitute the upper retention receiving structure 34A similar to that on the upper surface of the lower sub-housing S3. However, the retainers on the lower surface of the upper sub-housing need not constitute the same structure as that on the lower surface of the middle sub-housing (second sub-housing) and the retention receiving portions on the upper surface of the middle sub-housing (second sub-housing) need not constitute the same structure as that on the upper surface of the lowermost-stage sub-housing. In short, in the case of providing an additional sub-housing, retention receiving portions on the upper surface of the additional sub-housing may constitute a retention receiving structure similar to that constituted by the retention receiving portions on the upper surface of the lowermost-stage sub-housing and retainers on the lower surface of the additional sub-housing may constitute a retaining structure similar to that constituted by the retainers on the lower surface of the second sub-housing.

LIST OF REFERENCE SIGNS

10: joint connector (connector)
11: stacked housing
34: retention receiving portion
34A: upper retention receiving structure (retention receiving structure)
35: retainer
35A: lower retaining structure (retaining structure)
210L: first joint connector (first connector)
210R: second joint connector (second connector)
238: side wall
240 (240L, 240R): error connection preventing portion
S: sub-housing
S1: upper sub-housing
S2: middle sub-housing (second sub-housing)
S4: additional sub-housing
S3: lower sub-housing
T: terminal

What is claimed is:

1. A connector with a stacked housing configured by vertically stacking sub-housings in three or more stages, each of the sub-housings being configured for accommodating terminals, wherein:

each of the sub-housings include upper and lower surfaces spaced apart in a stacking direction of the sub-housings and cavities extending through the sub-housing in a front to back direction normal to the stacking direction, and the sub-housings include:

the upper sub-housing disposed in an uppermost stage, the upper sub-housing including retention receiving portions penetrating into the lower surface of the upper-sub-housing and communicating with the cavities of the upper-sub-housing, and retainers projecting from the lower surface, the retention receiving portions and retainers arranged side-by-side in a laterally alternating arrangement normal to the front to back direction and aligned with each other in a direction normal to the front to back direction;

a middle sub-housing disposed with the upper surface of the middle sub-housing facing the lower of the upper sub-housing, the middle sub-housing having retention receiving portions penetrating into the upper surface thereof and communicating with the cavities, and retainers projecting from the upper and lower surface thereof, the retention receiving portions and the retainers of the upper surface arranged side-by-side in the laterally alternating arrangement and aligned with each other in the direction normal to the front to back direction with the retention receiving portions configured to receive the retainers of the upper-sub housing, and a lower sub-housing disposed in a lowermost stage with the upper surface of the lower sub-housing facing the lower surface of the middle sub-housing, retention receiving portions formed on the upper surface of the lower sub-housing and configured to receive the retainers of the lower surface of the middle sub-housing; wherein the retainers of each of the sub-housing penetrate through the retention receiving portions of an adjacent on of the sub-housing to retain the terminals therein.

2. The connector claim 1, wherein the retainers on the upper sub-housing and the retainers on the middle sub-housing are disposed at the same position in a front-rear direction with the upper sub-housing and the middle sub-housing stacked.

3. The connector of claim 1, wherein:

the middle sub-housing includes a second sub-housing disposed to face the upper sub-housing and capable of accommodating the terminals and at least one additional sub-housing disposed between the second sub-housing and the lower sub-housing and capable of accommodating the terminals;

the retainers for retaining the terminals accommodated in each of the sub-housings are configured the same.

4. The connector of claim 1, comprising a first connector and a second connector in each of which side walls for laterally covering the terminals are provided and that are laterally arrangeable side by side with each other, wherein:

error connection preventing portions are embedded at mutually different positions in a front-rear direction on the side walls of the first connector and the side walls of the second connector; and the error connection preventing portions are provided for each sub-housing and respectively shaped to be fittable to each other in a predetermined stacking order.

5. A connector, comprising:

a middle housing and first and second outer housings, each of the housings having opposite front and rear ends, opposite first and second surfaces extending between the front and rear ends and cavities extending through the respective housings between the front and rear ends, the cavities being configured to accommodate terminals therein, wherein:

first retention openings are formed in the first surface of the first outer housing and communicate with the cavities of the first outer housing and first retainers project from the first surface of the first outer housing at positions laterally between the first retention openings and aligned laterally with the first retention openings;

middle retention openings are formed in the first surface of the middle housing and communicate with the cavities of the middle housing, first middle retainers project from the first surface of the middle housing at positions laterally between the middle retention openings and aligned laterally with the middle retention openings, and second middle retainers project from the second surface of the middle housing;

second retention openings are formed in the second surface of the second outer housing and communicate with the cavities of the second outer housing;

the first surface of the first outer housing is mounted on the first surface of the middle housing so that the first retainers project into the middle retention openings and retain the terminals in the cavities of the middle housing, and so that the first middle retainers project into the first retention openings and retain the terminals in the cavities of the first outer housing; and the second surface of the middle housing is mounted on the second surface of the second outer housing so that the second retainers project into the second retention openings and retain the terminals in the cavities of the second outer housing.

6. A connector, consisting of:

a middle housing and first and second outer housings, each of the housings having opposite front and rear ends, opposite first and second surfaces extending between the front and rear ends and cavities extending through the respective housings between the front and rear ends, the cavities being configured to accommodate terminals therein, wherein:

first retention openings are formed in the first surface of the first outer housing and communicate with the cavities of the first outer housing and first retainers project from the first surface of the first outer housing at positions laterally between the first retention openings and aligned laterally with the first retention openings;

middle retention openings are formed in the first surface of the middle housing and communicate with the cavities of the middle housing, first middle retainers project from the first surface of the middle housing at positions laterally between the middle retention openings and aligned laterally with the middle retention openings, and second middle retainers project from the second surface of the middle housing;

second retention openings are formed in the second surface of the second outer housing and communicate with the cavities of the second outer housing;

the first surface of the first outer housing is mounted on the first surface of the middle housing so that the first retainers project into the middle retention openings and retain the terminals in the cavities of the middle housing, and so that the first middle retainers project into the first retention openings and retain the terminals in the cavities of the first outer housing; and the second surface of the middle housing is mounted on the second surface of the second outer housing so that the second retainers project into the second retention openings and retain the terminals in the cavities of the second outer housing.

* * * * *